US007789322B2

(12) United States Patent
Yamamoto et al.

(10) Patent No.: US 7,789,322 B2
(45) **Date of Patent: *Sep. 7, 2010**

(54) FUEL INJECTION VALVE

(75) Inventors: Norio Yamamoto, Nagoya (JP); Kouichi Mochizuki, Anjo (JP)

(73) Assignee: Denso Corporation, Kariya (JP)

( * ) Notice: Subject to any disclaimer, the term of this patent is extended or adjusted under 35 U.S.C. 154(b) by 126 days.

This patent is subject to a terminal disclaimer.

(21) Appl. No.: 12/068,279

(22) Filed: Feb. 5, 2008

(65) Prior Publication Data

US 2008/0223960 A1 Sep. 18, 2008

(30) Foreign Application Priority Data

Mar. 13, 2007 (JP) ..... 2007-64101

(51) Int. Cl.
*F02M 47/02* (2006.01)

(52) U.S. Cl. ..... 239/88; 239/585.4; 239/585.5; 239/533.1; 239/89; 239/102.1

(58) Field of Classification Search ..... 239/88, 239/95, 102.1, 102.2, 533.1, 533.2, 585.1, 239/585.5, 585.4; 123/467
See application file for complete search history.

(56) References Cited

U.S. PATENT DOCUMENTS

| | | | | |
|---|---|---|---|---|
| 6,616,064 | B2 * | 9/2003 | Boecking | 239/96 |
| 6,749,137 | B2 * | 6/2004 | Kato et al. | 239/585.1 |
| 6,802,298 | B2 * | 10/2004 | Yoshimura et al. | 123/467 |
| 7,086,606 | B2 * | 8/2006 | Brooks et al. | 239/5 |
| 7,455,244 | B2 * | 11/2008 | Boecking | 239/102.2 |
| 7,506,827 | B2 * | 3/2009 | Petrone et al. | 239/585.1 |
| 2003/0052203 | A1 * | 3/2003 | Arndt et al. | 239/585.5 |
| 2006/0032940 | A1 | 2/2006 | Boecking | |
| 2006/0180679 | A1 * | 8/2006 | Boehland | 239/88 |
| 2007/0023542 | A1 * | 2/2007 | Stoecklein | 239/88 |
| 2007/0152084 | A1 * | 7/2007 | Boecking | 239/533.2 |
| 2008/0093484 | A1 * | 4/2008 | Stoecklein et al. | 239/585.5 |
| 2008/0163852 | A1 | 7/2008 | Kanne et al. | |
| 2008/0217428 | A1 * | 9/2008 | Yamamoto et al. | 239/88 |

FOREIGN PATENT DOCUMENTS

| | | |
|---|---|---|
| JP | 2004-346856 | 12/2004 |
| WO | WO 96/37698 | 11/1996 |
| WO | WO 2005075811 A1 * | 8/2005 |

OTHER PUBLICATIONS

Japanese Office Action dated Jan. 27, 2009, issued in corresponding Japanese Application No. 2007-064101, with English translation.

* cited by examiner

*Primary Examiner*—Len Tran
*Assistant Examiner*—Trevor E McGraw
(74) *Attorney, Agent, or Firm*—Nixon & Vanderhye PC

(57) ABSTRACT

A fuel injection valve includes a main body having a nozzle hole and a compression chamber. The main body accommodates a compression unit for pressurizing fuel accumulated in the compression chamber. The fuel injection valve further includes a valve element being axially movable in the main body. The valve element includes a valve portion and a pressure-receiving portion. The valve portion is movable in an opening direction to open the nozzle hole in response to pressure of fuel being pressurized by the compression unit and applied to the pressure-receiving portion. A regulating unit is provided in the compression chamber for regulating movement of the valve element with respect to the opening direction.

7 Claims, 3 Drawing Sheets

FUEL INJECTION VALVE

CROSS REFERENCE TO RELATED APPLICATIONS

This application is based on and incorporates herein by reference Japanese Patent Application No. 2007-64101 filed on Mar. 13, 2007.

FIELD OF THE INVENTION

The present invention relates to a fuel injection valve.

BACKGROUND OF THE INVENTION

In view of improving fuel consumption and reducing toxic substance from exhaust gas, a fuel injection valve is demanded to enhance accuracy in fuel injection control. According to WO 96/37698, for example, a fuel injection valve has a structure, in which a valve element is manipulated by utilizing fuel pressure to open and close a nozzle hole. In the structure of WO 96/37698, a control performance of fuel injection can be enhanced.

Specifically, the fuel injection valve of WO 96/37698 includes a main body, a valve element, and a piston. The main body has a nozzle hole and a compression chamber. The compression chamber accumulates fuel to pressurize the fuel therein. The valve element is axially movable in the main body. The valve element has a pressure-receiving portion via which the valve element is applied with pressure of fuel in the compression chamber. The piston pressurizes fuel in the compression chamber to apply pressure of the fuel to the pressure-receiving portion, thereby manipulating the valve element to open the nozzle hole. Thus, the fuel injection valve controls fuel injection.

In the structure of the fuel injection valve of WO 96/37698, the compression chamber accommodates components such as a string for biasing the piston. Therefore, the compression chamber needs a sufficient volume for accommodating components such as the spring. However, when the piston pressurizes fuel in a compression chamber with a large volume, the piston cannot promptly pressurize fuel in the compression chamber. Therefore, it is hard to enhance response of the valve element.

SUMMARY OF THE INVENTION

In view of the foregoing problems, it is an object of the present invention to produce a fuel injection valve capable of manipulating a valve element with high response.

According to one aspect of the present invention, a fuel injection valve comprises a main body having a nozzle hole and a compression chamber, the compression chamber adapted to accumulating fuel. The fuel injection valve further comprises a compression unit for pressurizing fuel in the compression chamber. The fuel injection valve further comprises a valve element being axially movable in the main body. The valve element includes a valve portion and a pressure-receiving portion. The valve portion is movable in an opening direction to open the nozzle hole in response to pressure of fuel being pressurized by the compression unit and applied to the pressure-receiving portion. The fuel injection valve further comprises a regulating unit provided in the compression chamber for regulating movement of the valve element with respect to the opening direction.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

Embodiment

Figure 1:
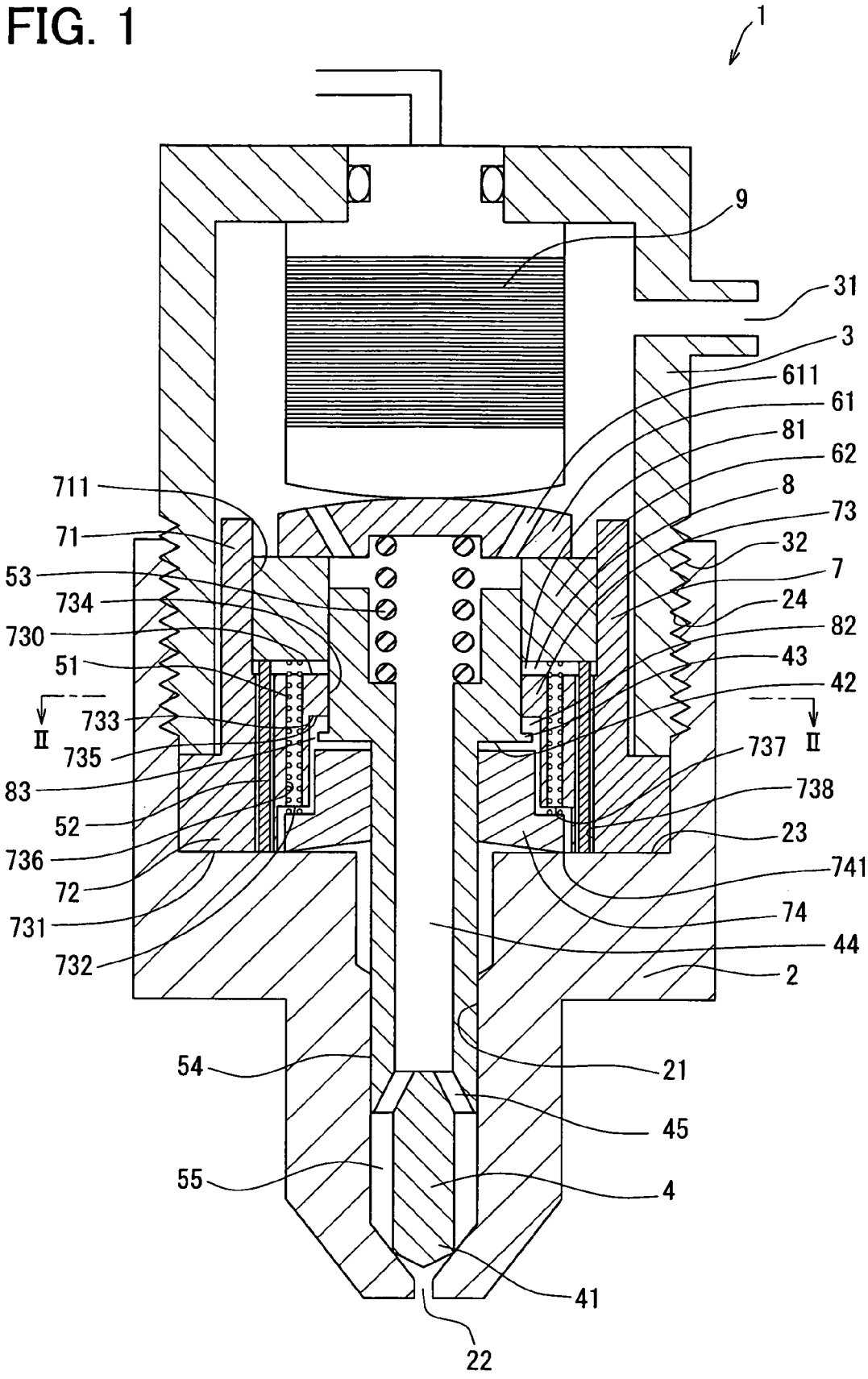
FIG. 1 is a sectional view showing a fuel injection valve.

As shown in FIG. 1, a fuel injection valve 1 is applied to a direct-injection gasoline engine, for example. When the fuel injection valve 1 is applied to a direct-injection gasoline engine, the fuel injection valve 1 is mounted to a cylinder head of the engine. The fuel injection valve 1 is not limited to being applied to a direct-injection gasoline engine. The fuel injection valve 1 may be applied to a port-injection gasoline engine, in which fuel is injected into air passing through an intake passage. The fuel injection valve 1 may also be applied to a diesel engine.

As shown in an FIG. 1, the fuel injection valve 1 is in a columnar shape, and includes a nozzle body 2 and a holder 3. The holder 3 supports the nozzle body 2. The nozzle body 2 has a nozzle hole 22 at one end. The holder 3 has a fuel inlet 31 at one end. The nozzle body 2 is joined with the holder 3 by screwing a female screw portion 24 of the nozzle body 2 to a male screw part 32 of the holder 3.

The fuel injection valve 1 accommodates a needle 4 and a control portion. The needle 4 as a valve element controls opening and closing of the nozzle hole 22. The control portion controls an operation of the needle 4. The control portion is controlled according to a control signal transmitted from a control device such as an electronic control unit (ECU, not shown).

The nozzle body 2 is substantially in a tubular shape, and provided with the nozzle hole 22 at a tip end. The nozzle body 2 has a longitudinal cavity 21 communicating with the nozzle hole 22. The needle 4 is supported in the longitudinal cavity 21 via a small clearance 54, and is axially movable in the longitudinal cavity 21. As shown in an FIG. 1, the nozzle body 2 has a step portion 23. The step portion 23 and the nozzle hole 22 are located on opposite sides of the needle 4 in the longitudinal cavity 21.

The needle 4 is substantially rod-shaped. The needle 4 has a valve element portion (valve portion) 41 at one end on the side of the nozzle hole 22 when being accommodate in the longitudinal cavity 21. The valve element portion 41 controls opening and closing of the nozzle hole 22. The needle 4 has a pressure-receiving portion 42 at the other end on the opposite side to the nozzle hole 22. The pressure-receiving portion 42 has a surface via which pressure is applied to the pressure-receiving portion 42, thereby the needle 4 can be moved to the opposite side of the nozzle hole 22. The outer circumferential periphery of the pressure-receiving portion 42 has a projection 43 projecting in the radial direction of the needle 4.

In a condition where the needle 4 is accommodated in the longitudinal cavity 21 of the nozzle body 2, the sidewall of the needle 4 and the inner wall defining the longitudinal cavity 21 therebetween define a fuel accumulator chamber 55. The fuel accumulator chamber 55 is supplied with fuel from the fuel inlet 31 provided in the holder 30. When the needle 4 is moved in a closing direction toward the nozzle hole 22 and the valve element portion 41 is seated to the surface defining the longitudinal cavity 21, the fuel accumulator chamber 55 is blocked from the nozzle hole 22, thereby fuel injection from the nozzle hole 22 is terminated. When the needle 4 is moved in an opening direction, which is opposite to the closing direction, and the valve element portion 41 is lifted from the surface defining the longitudinal cavity 21, the fuel accumulator chamber 55 is communicated with the nozzle hole 22, thereby fuel is injected through the nozzle hole 22.

A fuel passage 44 is provided in the needle 4. The fuel passage 44 extends from the end of the needle 4 on the opposite side to the nozzle hole 22 to an intermediate portion of the needle 4. One end of the fuel passage 44 communicates with the fuel accumulator chamber 55 through a third communication passage 45. The needle 4 has a surface partially defining the fuel passage 44, and the surface supports one end of a third spring 53. The third spring 53 biases the needle 4 in the closing direction. The needle 4 is provided with the control portion on the opposite side of the nozzle hole 22. The control portion includes a piezo actuator 9, a first piston 61, a second piston 62, a piston liner 7, and a seat member 74, which are combined together to define thereamong a compression chamber 8. The compression chamber 8 surrounds the pressure-receiving portion 42 of the needle 4.

As shown in FIG. 1, the piston liner 7 and the seat member 74 are provided to the step portion 23 of the nozzle body 2. The seat member 74 is an annular member located between the pressure-receiving portion 42 of the needle 4 and the step portion 23. The seat member 74 is located closer to the nozzle hole 22 than the compression chamber 8, and partially defines the compression chamber 8. The lower end surface of the seat member 74 defines a seat portion 741 being in contact with the step portion 23. The seat portion 741 is in contact with the step portion 23, thereby restricting fuel from flowing into the compression chamber 8 through the small clearance 54. The inner wall of the seat member 74 is supported by the needle 4, thereby the seat member 74 is axially movable.

The piston liner 7 is provided around the outer circumferential periphery of the seat member 74. The piston liner 7 includes a cylinder portion 71, a flange portion 72, and a partition 73. The flange portion 72 is provided on the outer circumferential wall of the cylinder portion 71 on the side of the step portion 23. The partition 73 extends from the inner wall of the cylinder portion 71 on the side of the step portion 23 toward a center axis of the cylinder portion 71. The flange portion 72 is interposed between the step portion 23 of the nozzle body 2 and an end of the holder 3. In the present structure, the piston liner 7 is firmly fixed relative to the nozzle body 2 and the holder 3. The inner wall of the cylinder portion 71 has a sliding portion 711. The sliding portion 711 and the nozzle hole 22 are located on opposite sides of the partition 73. The sliding portion 711 axially slidably supports a second piston 62. The second piston 62 partitions an upper surface defining the compression chamber 8, the upper surface and the nozzle hole 22 being located on the opposite sides of the compression chamber 8. Components of the fuel injection valve 1, namely the nozzle body 2, the holder 3, and the partition 73, may be characterized as constituting a main body.

The partition 73 extends from the inner wall of the cylinder portion 71 toward the center axis of the cylinder portion 71. The partition 73 is stepwise such that the inner diameter of the partition 73 increases toward the nozzle hole 22. The partition 73 has an upper end surface 730 on the opposite side of the nozzle hole 22. The upper end surface 730 is opposed to the lower end surface of the second piston 62 in a condition where the second piston 62 is provided in the sliding portion 711. The cylinder portion 71 has three surfaces on the side of the nozzle hole 22, and the three surfaces includes a first lower end surface 731 in the most vicinity of the nozzle hole 22. The first lower end surface 731 is in contact with the step portion 23. The cylinder portion 71 has a second lower end surface 732 on the radially inner side of the first lower end surface 731. The cylinder portion 71 has a third lower end surface 733 on the radially inner side of the second lower end surface 732.

The upper end surface 730 and the third lower end surface 733 therebetween define a supporting member 734. The supporting member 734 axially slidably supports a portion of the needle 4, the portion of the needle 4 and the nozzle hole 22 being located on the opposite sides of the pressure-receiving portion 42 of the needle 4. In the present structure, the needle 4 can be supported at the end on the opposite side of the nozzle hole 22, thereby the axial movement of the needle 4 can be stabilized. The third lower end surface 733 also serves as a contact portion 735. When the needle 4 moves in the opening direction by a predetermined distance, the projection 43 of the needle 4 makes contact with the contact portion 735, so that the contact portion 735 regulates a movable length of the needle 4 with respect to the opening direction of the needle 4. The contact portion 735 and the projection 43 may serve as a regulating unit. The second lower end surface 732 is opposed to the upper end surface of the seat member 74. Referring to FIG. 1, the pressure-receiving portion 42 of the needle 4 is located between the third lower end surface 733 and the second lower end surface 732 in a condition where the needle 4 is attached to the fuel injection valve 1.

The partition 73 has second communication passages 736 and accommodation holes 738. Each of the second communication passages 736 as a communication passage communicates the upper end surface 730 with the second lower end surface 732. Each of the accommodation holes 738 communicates the upper end surface 730 with the first lower end surface 731. The second communication passages 736 respectively accommodate first springs 51. Each first spring 51 as a first biasing member is supported at one end by the upper end surface of the seat member 74, and is supported at the other end by the lower end surface of the second piston 62. The second lower end surface 732 is located closer to the nozzle hole 22 than the pressure-receiving portion 42 of the needle 4. Each second communication passage 736 has an opening 737 located on the side of the nozzle hole 22 with respect to the pressure-receiving portion 42 of the needle 4. That is, the opening 737 is located closer to the nozzle hole 22 than the pressure-receiving portion 42 of the needle 4. Each accommodation hole 738 accommodates a second spring 52. The second spring 52 as a second biasing member is supported at one end by the lower end surface of the second piston 62, and is supported at the other end by the step portion 23.

Figure 2:
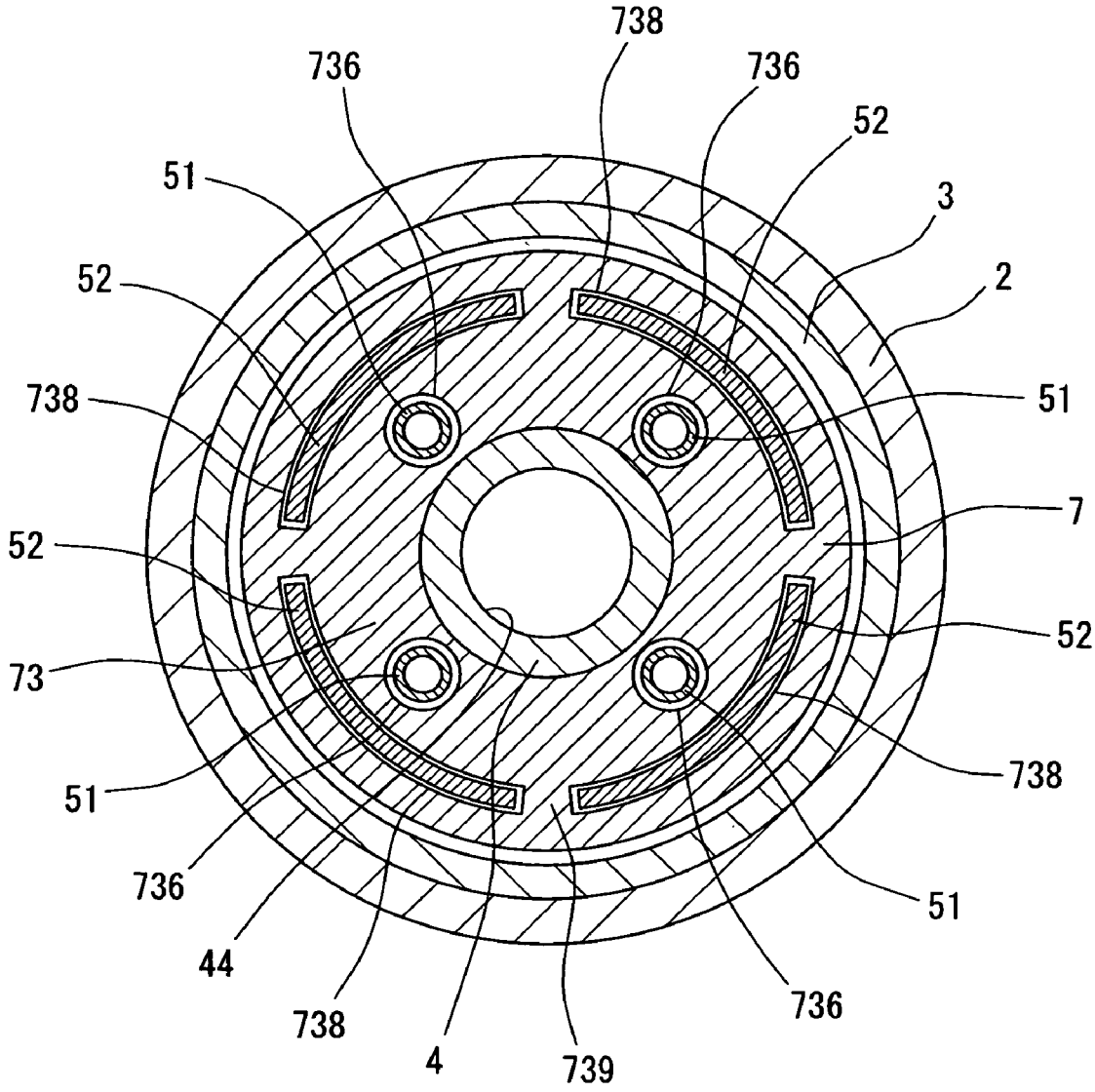
FIG. 2 is a sectional view taken along a line II-II in FIG. 1.

As shown in FIG. 2, four of the second communication passages 736 are provided on an imaginary circle defined around the center axis of the needle 4. Each of the second communication passages 736 is a circular passage having a predetermined inner diameter. Each first spring 51 is a coil spring accommodated in each second communication passage 736. The first spring 51 is located between the second piston 62 and the seat member 74, thereby regularly biasing the seat portion 741 of the seat member 74 on the step portion 23.

Four of the accommodation holes 738 are provided on the radially outer side of the second communication passages 736. The accommodation holes 738 are located on an imaginary defined around the center axis of the needle 4. Each of the accommodation holes 738 is arc-shaped. A bridge portion 739 is provided between circumferentially adjacent two of the accommodation holes 738. Each bridge portion 739 connects a portion of the partition 73 on the radially outer side of the accommodation hole 738 with a portion of the partition 73 on the radially inner side of the accommodation hole 738. Each second spring 52 is an arc-shaped metal plate accommodated in each accommodation hole 738. The second spring 52 as the arc-shaped metal plate has the sidewall with multiple slit-shaped notches, thereby the second spring 52 is enhanced in resiliency in the plane direction thereof.

Referring to FIG. 1, the second piston 62 is substantially in the shape of an annular ring. The second piston 62 has an outer shape correspondingly to the shape of the sliding portion 711 of the piston liner 7. The second piston 62 is axially movably supported by the sliding portion 711. The inner wall of the second piston 62 axially movably supports the sidewall of the end of the needle 4 on the opposite side of the nozzle hole 22.

Referring to FIG. 1, the seat member 74, the piston liner 7, and the second piston 62 are attached to the step portion 23 of the nozzle body 2 on the opposite side of the nozzle hole 22. In this condition, the upper end surface of the seat member 74, the second lower end surface 732 of the piston liner 7, the third lower end surface 733 of the piston liner 7, the upper end surface 730 of the piston liner 7, the lower end surface of the second piston 62, and the sidewall of the needle 4 thereamong define the compression chamber 8.

The compression chamber 8 is divided into two chambers by the partition 73. One of the two chambers is a counter-nozzle side compression chamber (first chamber) 81 partitioned by the upper end surface 730 of the piston liner 7, the lower end surface of the second piston 62, and the sidewall of the needle 4. The other of the two chambers is a nozzle side compression chamber (second chamber) 82 partitioned by the upper end surface of the seat member 74, the second lower end surface 732 of the piston liner 7, the third lower end surface 733 of the piston liner 7, and the sidewall of the needle 4. The second communication passages 736 provided in the partition 73 communicate the counter-nozzle side compression chamber 81 with the nozzle side compression chamber 82. The nozzle side compression chamber 82 is located closer to the nozzle hole 22 than the counter-nozzle side compression chamber 81.

Both the compression chambers 81, 82 are filled with fuel flowing from the fuel inlet 31. The pressure-receiving portion 42 and the projection 43 of the needle 4 are accommodated in the nozzle side compression chamber 82. The tip end of the projection 43 and the sidewall of the piston liner 7 therebetween define a throttle 83. The first piston 61 substantially in a disc shape is provided on the upper end surface of the second piston 62. The piezo actuator 9 as a driving device is provided on the opposite side of the nozzle hole 22. The first piston 61 transmits driving force of the piezo actuator 9 to the second piston 62. A first communication passage 611 axially extends through both end surfaces of the first piston 61. The lower end surface of the first piston 61 supports the third spring 53 to bias the needle 4 in the closing direction. The first and second pistons 61, 62 are moved toward the nozzle hole 22, thereby the volume of the compression chamber 8 is reduced to pressurize fuel in the compression chamber 8. The first and second pistons 61, 62 serve as a compression unit.

The piezo actuator 9 as a driving device is accommodated in a space inside of the holder 3. The space in the holder 3 is filled with fuel flowing from the fuel inlet 31. The piezo actuator 9 is constructed by alternately laminating a piezo-electric ceramic layers formed of lead zirconate titanate (PZT) and electrode layers, for example. The piezo actuator 9 accumulates an electric charge in the piezo-electric ceramic layer and emits the electric charge in accordance with a control signal transmitted from a drive circuit (not shown). Thereby, the piezo actuator 9 is expanded and contracted in a laminating direction, i.e., in the vertical direction.

The piezo actuator 9 is expanded when accumulating electric charge, and contracted when emitting the electric charge. The lower end of the piezo actuator 9 is in contact with the first piston 61. Therefore, the expansion and contraction of the piezo actuator 9 is transmitted to the first piston 61.

Figure 3:
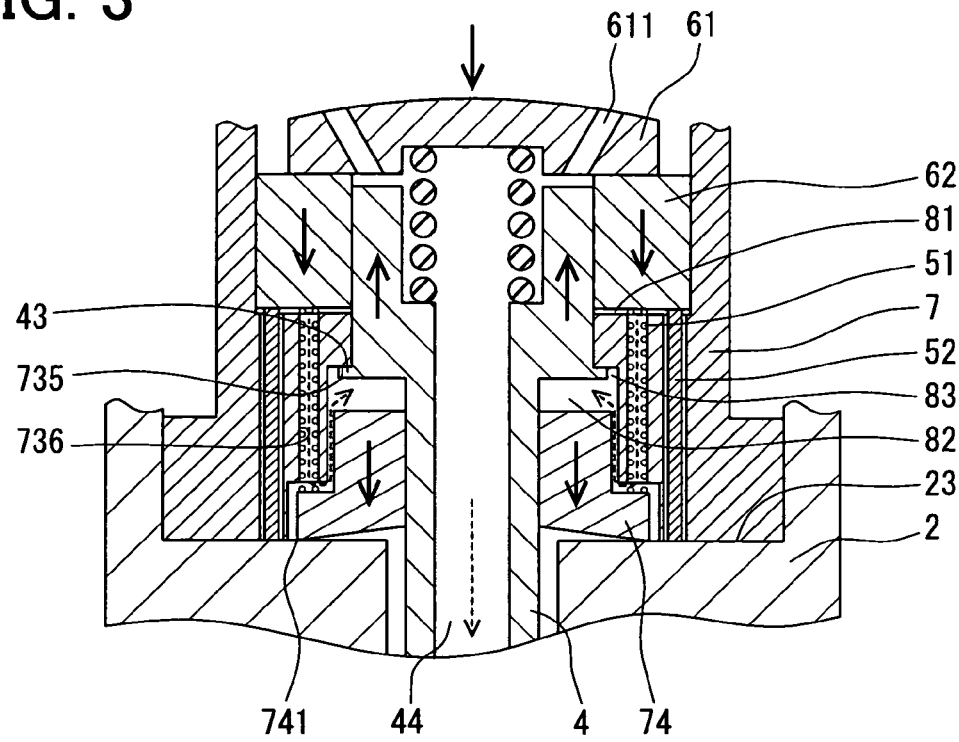
FIG. 3 is a sectional view showing components of the fuel injection valve when the fuel injection valve injects fuel.
Figure 4:
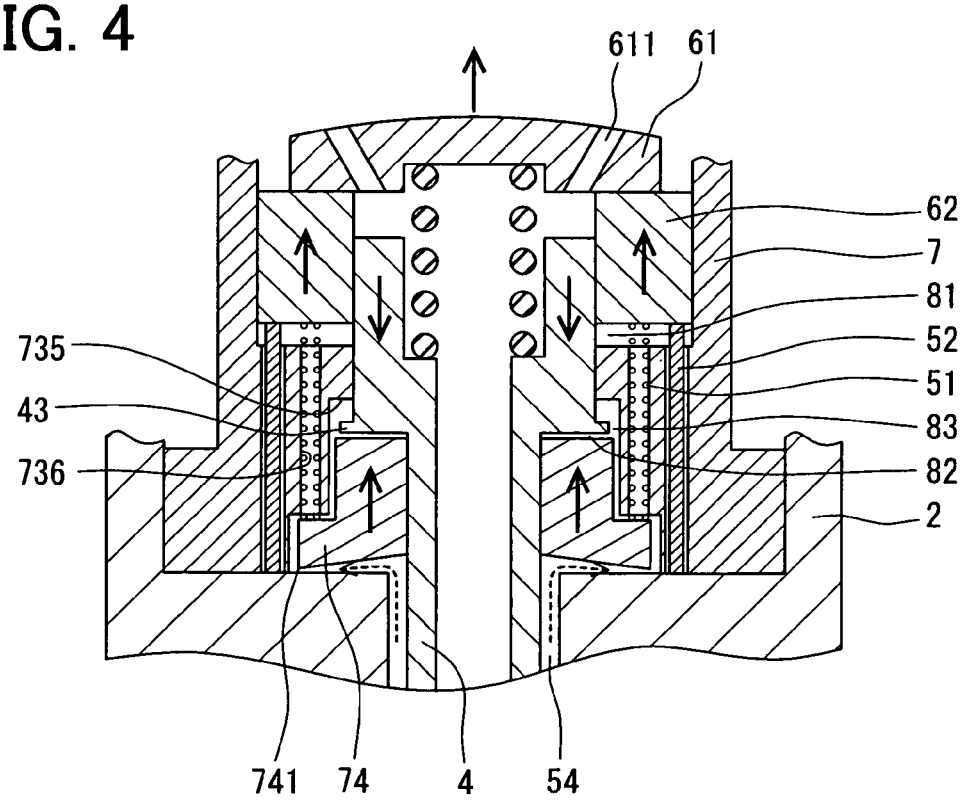
FIG. 4 is a sectional view showing components of the fuel injection valve when the fuel injection valve terminates fuel injection.

Next, an operation of the fuel injection valve 1 is described with reference to FIGS. 3, 4. FIG. 3 shows the fuel injection valve of FIG. 1 when injecting fuel, and FIG. 4 shows the fuel injection valve when terminating the fuel injection. The solid arrows illustrated in FIGS. 3, 4 indicate movements of the components. The dashed arrows indicate fuel flows.

As shown in FIG. 3, when the piezo actuator 9 is expanded by being charged with electricity, the first piston 61 moves toward the nozzle hole 22, and the second piston 62 also moves toward the nozzle hole 22. As the second piston 62 moves toward the nozzle hole 22, the first springs 51 and the second springs 52 are compressed.

As the second piston 62 moves toward the nozzle hole 22, the volume of the compression chamber 81 decreases, thereby fuel filled in the counter-nozzle side compression chamber 81 is pressurized to be pressurized fuel. The pressurized fuel flows to the nozzle side compression chamber 82 after passing through the second communication passages 736 of the partition 73. The opening 737 of each second communication passage 736 is located closer to the nozzle hole 22 than the pressure-receiving portion 42 of the needle 4. Therefore, the pressurized fuel flows from the side, which is close to the nozzle hole 22, toward the opposite side of the nozzle hole 22, and flows to the pressure-receiving portion 42. The pressure-receiving portion 42 is applied with pressure of the pressurized fuel, thereby the needle 4 is moved in the opening direction, i.e., to the opposite side of the nozzle hole 22. Thus, the valve element portion 41 is lifted from the surface defining the longitudinal cavity 21, so that fuel is injected from the fuel accumulator chamber 55 through the nozzle hole 22.

As shown in FIG. 4, when the piezo actuator 9 discharges electricity to contract, the first and second pistons 61, 62 are automatically moved to the opposite side of the nozzle hole 22 by being biased with the presently pressurized first and second springs 51, 52. Thus, the first and second pistons 61, 62 return to initial positions.

When the first and second pistons 61, 62 are move to the opposite side of the nozzle hole 22, the counter-nozzle side compression chamber 81 and the nozzle side compression chamber 82 increase in volume, thereby pressure in both the compression chambers 81, 82 decreases. When pressure in both the compression chambers 81, 82 decreases to be less than pressure of fuel flowing from the fuel inlet 31, pressure applied to the lower end surface of the seat member 74 becomes greater than biasing force of the first springs 51. Thus, the seat member 74 moves to the opposite side of the nozzle hole 22. The seat portion 741 moves away from the step portion 23, and fuel flows from the fuel accumulator chamber 55 into both the compression chambers 81, 82 through the small clearance 54 as a supply passage.

Differential pressure between the compression chamber 8 and the fuel accumulator chamber 55 changes in accordance with movement of the first and second pistons 61, 62. The seat member 74 automatically moves according to the pressure difference, so that the compression chamber 8 can be easily supplied with fuel. Pressure in both the compression chambers 81, 82 decreases, so that the needle 4 moves toward the nozzle hole 22 in the closing direction by being applied with biasing force of the third spring 53. The valve element portion 41 is seated to the surface defining the longitudinal cavity 21, thereby terminating fuel injection through the nozzle hole 22.

In present embodiment, the contact portion 735 and the projection 43 as the regulating unit are provided in the compression chamber 8. Therefore, the volume of the compression chamber 8 can be substantially reduced. The volume of the compression chamber 8 can be reduced, so that response of the needle 4 can be enhanced even in the fuel injection valve 1 in which the needle 4 is hydraulically driven with fuel pressure.

In the present embodiment, the compression chamber 8 accommodates the regulating unit to regulate the movement of the needle 4 with respect to the opening direction, thereby the volume of the compression chamber 8 can be substantially reduced. Therefore, the maximum lift of the needle 4 can be physically restricted, so that fuel injection can be stabilized. The regulating unit has a simple structure including the projection 43, which is provided to the needle 4, and the contact portion 735 provided to the partition 73.

In the present embodiment, the first and second pistons 61, 62 directly pressurize fuel in the compression chamber 8. Therefore, fuel in the compression chamber 8 can be promptly pressurized, so that response of the needle 4 can be enhanced.

The nozzle hole 22 is provided on the side of injection of fuel. Therefore, the fuel injection valve 1 does not have an internal space closer to the nozzle hole 22 than the compression chamber 8 sufficiently for accommodating components of the fuel injection valve 1. In the present embodiment, the first and second pistons 61, 62 and the nozzle hole 22 are located on the opposite sides of the compression chamber 8, and the first and second pistons 61, 62 pressurize fuel in the compression chamber 8. Therefore, a space for accommodating the piezo actuator 9 can be secured in the fuel injection valve 1.

In the present structure of the first and second pistons 61, 62, fuel pressurized in the compression chamber 8 flows toward the nozzle hole 22. That is, the flow direction of fuel pressurized in the compression chamber 8 and the opening direction of the needle 4 are opposite to each other. In the present embodiment, the partition 73 divides the compression chamber 8 into two of the counter-nozzle side compression chamber 81 and the nozzle side compression chamber 82. The counter-nozzle side compression chamber 81 accommodates the first and second pistons 61, 62. The nozzle side compression chamber 82 accommodates the pressure-receiving portion 42. The partition 73 has the second communication passages 736, which communicate both the compression chambers 81, 82 with each other. Each second communication passage 736 has the opening 737 in the nozzle side compression chamber 82, and the opening 737 is located closer to the nozzle hole 22 than the pressure-receiving portion 42.

In the present structure, fuel pressurized in the first and second pistons 61, 62 can be lead from the side, which is closer to the nozzle hole 22, toward the opposite side of the nozzle hole 22. Specifically, fuel in the counter-nozzle side compression chamber 81 is pressurized by the first and second pistons 61, 62, and the fuel is lead into the nozzle side compression chamber 82 after passing through the second communication passages 736 and the openings 737. Each opening 737 is located on the side of the nozzle hole 22 with respect to the pressure-receiving portion 42. That is, each opening 737 is located closer to the nozzle hole 22 than the pressure-receiving portion 42, so that fuel flowing into the nozzle side compression chamber 82 applies pressure from the side closer to the nozzle hole 22 to the pressure-receiving portion 42. In the present structure, the direction of pressure applied from the pressurized fuel to the pressure-receiving portion 42 is substantially the same as the opening direction of the needle 4. Consequently, response of the needle 4 can be enhanced.

The sidewall of the piston liner 7 is opposed to the tip end of the projection 43. The sidewall of the piston liner 7 defines the nozzle side compression chamber 82. The tip end of the projection 43 and the sidewall of the piston liner 7 therebetween define the throttle 83. In the present structure, when fuel is pressurized in the compression chamber 8, the pressurized fuel is restricted from flowing into the space between the projection 43 and the contact portion 735. Thus, the pressurized fuel can be restricted from disturbing movement of the needle 4 with respect to the opening direction, so that response of the needle 4 can be enhanced.

In the present embodiment, the seat member 74 is regularly biased to the step portion 23 with the first springs 51. Therefore, the seat member 74 can be restricted from irregularly moving due to vibration of the vehicle equipped with the fuel injection valve 1, so that fuel can be restricted from flowing backward from the compression chamber 8 into the small clearance 54. The first springs 51 are accommodated in the second communication passages 736 of the partition 73. Therefore, holes for accommodating the first springs 51 need not be additionally provided. Thus, the volume of the compression chamber 8 can be restricted from increasing due to an additional hole or the like.

In the present embodiment, the piezo actuator 9 with quick response is used to drive the first and second pistons 61, 62. The piezo actuator 9 is excellent in response compared with an electromagnetic actuator. Thus, response of the needle 4 can be enhanced. Nevertheless, an electromagnetic actuator may be provided instead of the piezo actuator 9.

It should be appreciated that while the processes of the embodiments of the present invention have been described herein as including a specific sequence of steps, further alternative embodiments including various other sequences of these steps and/or additional steps not disclosed herein are intended to be within the steps of the present invention.

Various modifications and alternations may be diversely made to the above embodiments without departing from the spirit of the present invention.

What is claimed is:

1. A fuel injection valve comprising:

a main body having a nozzle hole and a compression chamber, the compression chamber adapted to accumulating fuel;

a compression unit for pressurizing fuel in the compression chamber;

a valve element being axially movable in the main body, the valve element including a valve portion and a pressure-receiving portion, the valve portion being movable in an opening direction to open the nozzle hole in response to pressure of fuel being pressurized by the compression unit and applied to the pressure-receiving portion; and a regulating unit provided in the compression chamber for regulating movement of the valve element with respect to the opening direction, wherein the regulating unit includes a projection and a contact portion, the projection projects from a sidewall of the valve element to the compression chamber, the sidewall being exposed to the compression chamber, the contact portion is provided to an inner wall of the main body, the inner wall being exposed to the compression chamber, the contact portion is adapted to being in contact with the projection when the valve element moves in the opening direction by a predetermined distance, the compression unit includes a piston and a driving device, the driving device is adapted to biasing the piston to reduce a volume of the compression chamber for pressurizing fuel in the compression chamber, the main body includes a partition provided in the compression chamber to divide the compression chamber into a first chamber and a second chamber, the second chamber is located closer to the nozzle hole than the first chamber, the second chamber accommodating the pressure-receiving portion, the first chamber and the nozzle hole are located on opposite sides of the second chamber, the first chamber accommodating the piston, the partition has a communication passage, which communicates the first chamber with the second chamber, the communication passage has an opening on the side of the second chamber, and the opening is located closer to the nozzle hole than the pressure-receiving portion.

2. The fuel injection valve according to claim 1, wherein the partition and the communication passage are located in the main body, and the partition has an end axially movably supporting the valve element.

3. The fuel injection valve according to claim 1, wherein the projection and the contact portion are located between the partition on the side of the second chamber and the pressure-receiving portion, the projection is located closer to the nozzle hole than the contact portion, the projection has a tip end opposed to an inner wall defining the second chamber, and the tip end and the inner wall therebetween define a throttle.

4. The fuel injection valve according to claim 1, further comprising:

a first biasing member accommodated in the communication passage of the partition, wherein the first biasing member biases the seat member so as to block the compression chamber from the supply passage.

5. The fuel injection valve according to claim 4, further comprising:

a second biasing member accommodated in the compression chamber to bias the piston so as to increase a volume of the compression chamber.

6. The fuel injection valve according to claim 1, wherein the driving device is a piezo actuator.

7. A fuel injection valve comprising:

a main body having a nozzle hole and a compression chamber, the compression chamber adapted to accumulating fuel;

a compression unit for pressurizing fuel in the compression chamber;

a valve element being axially movable in the main body, the valve element including a valve portion and a pressure-receiving portion, the valve portion being movable in an opening direction to open the nozzle hole in response to pressure of fuel being pressurized by the compression unit and applied to the pressure-receiving portion; and a regulating unit provided in the compression chamber for regulating movement of the valve element with respect to the opening direction, wherein the regulating unit includes a projection and a contact portion, the projection projects from a sidewall of the valve element to the compression chamber, the sidewall being exposed to the compression chamber, the contact portion is provided to an inner wall of the main body, the inner wall being exposed to the compression chamber, the contact portion is adapted to being in contact with the projection when the valve element moves in the opening direction by a predetermined distance, the compression unit includes a piston and a driving device, and the driving device is adapted to biasing the piston to reduce a volume of the compression chamber for pressurizing fuel in the compression chamber, further comprising:

a seat member accommodated in the compression chamber, wherein the seat member blocks the compression chamber from the supply passage when the piston pressurizes fuel in the compression chamber, the main body has a supply passage for leading fuel from an outside of the compression chamber into the compression chamber, and the seat member communicates the compression chamber with the supply passage when the piston stops pressurizing of fuel in the compression chamber.

* * * * *